US006079540A

United States Patent [19]

Bolen

[11] Patent Number: 6,079,540

[45] Date of Patent: Jun. 27, 2000

[54] COIN MECHANISM FOR BULK VENDING MACHINE

[75] Inventor: Richard K. Bolen, Champaign, Ill.

[73] Assignee: The Northwestern Corporation, Morris, Ill.

[21] Appl. No.: 09/067,925

[22] Filed: Apr. 28, 1998

[51] Int. Cl.[7] ..... G07F 5/02

[52] U.S. Cl. ..... 194/255

[58] Field of Search ..... 194/292, 236, 194/237, 255, 203

[56] References Cited

U.S. PATENT DOCUMENTS

D. 332,285 1/1993 Bolen .
5,190,133 3/1993 Bolen .
5,339,937 8/1994 Bolen .
5,383,545 1/1995 Schwarzli ..... 194/236
5,509,521 4/1996 Bolen .

*Primary Examiner*—Robert P. Olszewski
*Assistant Examiner*—Bryan Jaketic
*Attorney, Agent, or Firm*—Brinks Hofer Gilson & Lione

[57] ABSTRACT

A coin receiving mechanism for a bulk vending machine and a method for operation thereof comprising a face plate; a coin wheel received in an indention formed in a backside of the face plate, the coin wheel formed therein a first coin slot for receiving coins; and a biased pawl movable between a first position and a second position and located in a recess formed in a backside of the face plate, the pawl having a secondary beak formed therein, wherein the secondary beak bears against an edge of a coin in the first coin slot as the coin passes.

39 Claims, 5 Drawing Sheets

COIN MECHANISM FOR BULK VENDING MACHINE

BACKGROUND OF THE INVENTION

The present invention relates to an improved coin receiving mechanism for a bulk vending machine and a method of operating the mechanism, and more particularly to a bulk vending machine having an improved coin mechanism having a pawl that provides for rejecting counterfeit disks or coins from the mechanism.

Bulk vending machines occupy a special and important position not just because of the sales generated therefrom but because of the unique niche that these machines possess in the minds of the public. The bulk vending machine has endured and thrived as a fixture of the retail environment. At least one bulk vending machine and more likely several, can be found in the entrance way or lobby of nearly every supermarket, department store, hardware store, gas station and restaurant in the United States. The proceeds of the bulk vending machine may augment the income of the proprietor of the premises where it is located or the proceeds may be shared with or donated to charitable organizations.

The bulk vending machine is intended to operate unattended and without normal supervision or attention by a person of the staff of the establishment where it is located. It is, therefore, important that the bulk vending machine be highly reliable, durable, and resistant to vandalism or pilferage.

One part of the bulk vending machine that is susceptible to vandalism or pilferage is the coin receiving mechanism. The coin receiving mechanism fits into an opening in a housing portion of the bulk vending machine and serves to operate a merchandise dispensing mechanism of the bulk vending machine upon receipt of the proper coin or coins. The coin receiving mechanism typically includes a handle to be manually rotated, a face plate, and a rearward facing gear that engages a corresponding gear of the merchandise dispensing mechanism. The coin wheel includes a coin receiving slot sized and adapted to receive a coin of the proper denomination.

The coin receiving mechanism of a bulk vending machine typically incorporates features that distinguish between a coin of the proper denomination and coins of other than the proper denomination or counterfeit coins. Because bulk vending machines may be unattended, stand-alone devices and are usually not connected electrically to a power source, the coin receiving mechanism in a bulk vending machine should reliably distinguish coins of the proper denomination from coins of other than the proper denomination without relying on the provision of an external power source. Conventionally, a coin receiving mechanism uses the dimensions of the coin as a basis for acceptance or rejection.

It is particularly desirable if the wrong coin can be readily expelled without jamming the machine. Accordingly, some bulk vending machines provide a spring-loaded pawl located in the coin receiving mechanism that contacts a part of the coin wheel of the mechanism to stop its clockwise motion unless a coin of proper denomination is inserted in the mechanism.

Although prior pawls operate to distinguish between genuine coins and counterfeit coins when these coins are different sizes, if the counterfeit coin is very close in size to the genuine coin, the pawl may not be able to reliably distinguish between them. This may occur when the counterfeit coin is made out of a hard or stiff material such as cardboard, aluminum, iron, or tile. Accordingly, it would be desirable in a coin receiving mechanism for a bulk vending machine to provide a way for reliably distinguishing between similar sized genuine coins and counterfeit coins.

Further, it would be desirable to provide a means to distinguish between such coins in a coin receiving mechanism for a bulk vending machine that is relatively inexpensive to manufacture and maintain.

SUMMARY OF THE INVENTION

A new and unique pawl for use in a vending machine mechanism has been invented which overcomes many of the deficiencies noted above.

In a first aspect the present invention is a coin receiving mechanism for a vending machine comprising: a face plate; a coin wheel received in an indention formed in a backside of said face plate, said coin wheel having formed therein a first coin slot for receiving coins; and a biased pawl movable between a first position and a second position and located in a recess formed in a backside of said face plate, said pawl having a secondary beak formed therein and wherein, said secondary beak bears against an edge of a coin in said first coin slot as said coin passes.

In another aspect the invention is a method for operating a vending machine comprising: accepting a coin of required size and stiffness; rejecting a counterfeit coin of less stiffness than a required coin by contacting said counterfeit coin with a biased pawl movable between a first position and a second position, said pawl having a secondary beak formed therein and wherein, said secondary beak bears against an edge of said counterfeit coin as said counterfeit coin passes resulting in said pawl moving from a first position to a second position.

The preferred embodiment of the present invention provides a new and unique pawl for use in a vending machine mechanism which is capable of measuring a coin or disk and rejecting coins of improper denomination and counterfeit coins that are made of a hard or stiff material.

A significant amount of pressure is applied to the edge of the coin or disk at the secondary beak. Inserting a counterfeit coin into the coin slot results in the downward movement of the pawl and engagement of the primary beak with the slot thereby stopping the clockwise movement of the coin wheel. Finally, the pawl is cost effective to manufacture and easily maintainable.

DETAILED DESCRIPTION OF A PREFERRED EMBODIMENT

Figure 1:
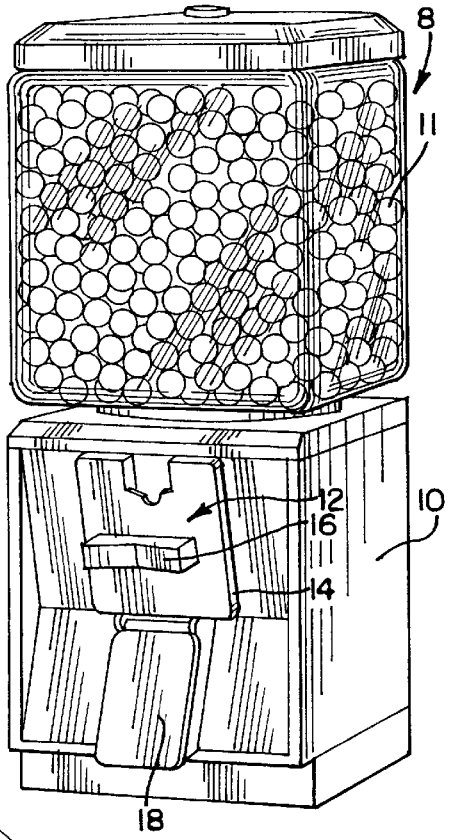
FIG. 1 is a perspective view of a bulk vending machine incorporating an embodiment of the present invention.

Referring to FIG. 1, there is shown a bulk vending machine 8. In one embodiment, the bulk vending machine 8 is a standard M60® bulk vending machine made by the Northwestern Corp. of Morris, Ill. The bulk vending machine 8 includes a base unit 10 and a product holder 11. The base unit 10 may be a generally rectangular metal housing. The product holder 11 may be made of a molded high strength clear plastic. The present embodiment may be incorporated in bulk vending machines other than the M60®, such as the Triple Play®, also made by the Northwestern Corp., or other bulk vending machines. The bulk vending machine 8 may be mounted on, or include, a stand (not shown), typically having a heavy base portion and a post extending from the base portion to engage the base unit 10.

The bulk vending machine 8 includes a coin receiving portion 12. The coin receiving portion 12 is mounted in a forwardly oriented opening in the base unit 10. The coin receiving portion 12 includes a face plate 14 and a handle 16. The coin receiving portion 12 actuates a product dispensing portion (not shown) located inside of the base unit 10 upon the payment of a coin of the proper denomination into the coin receiving portion 12 and the operation of the handle 16 in a manner that is well known in the art. Dispensing of the product by the product dispensing portion is via a chute 18 located adjacent to the coin receiving portion 12 also located on the base unit 10.

Figure 2:
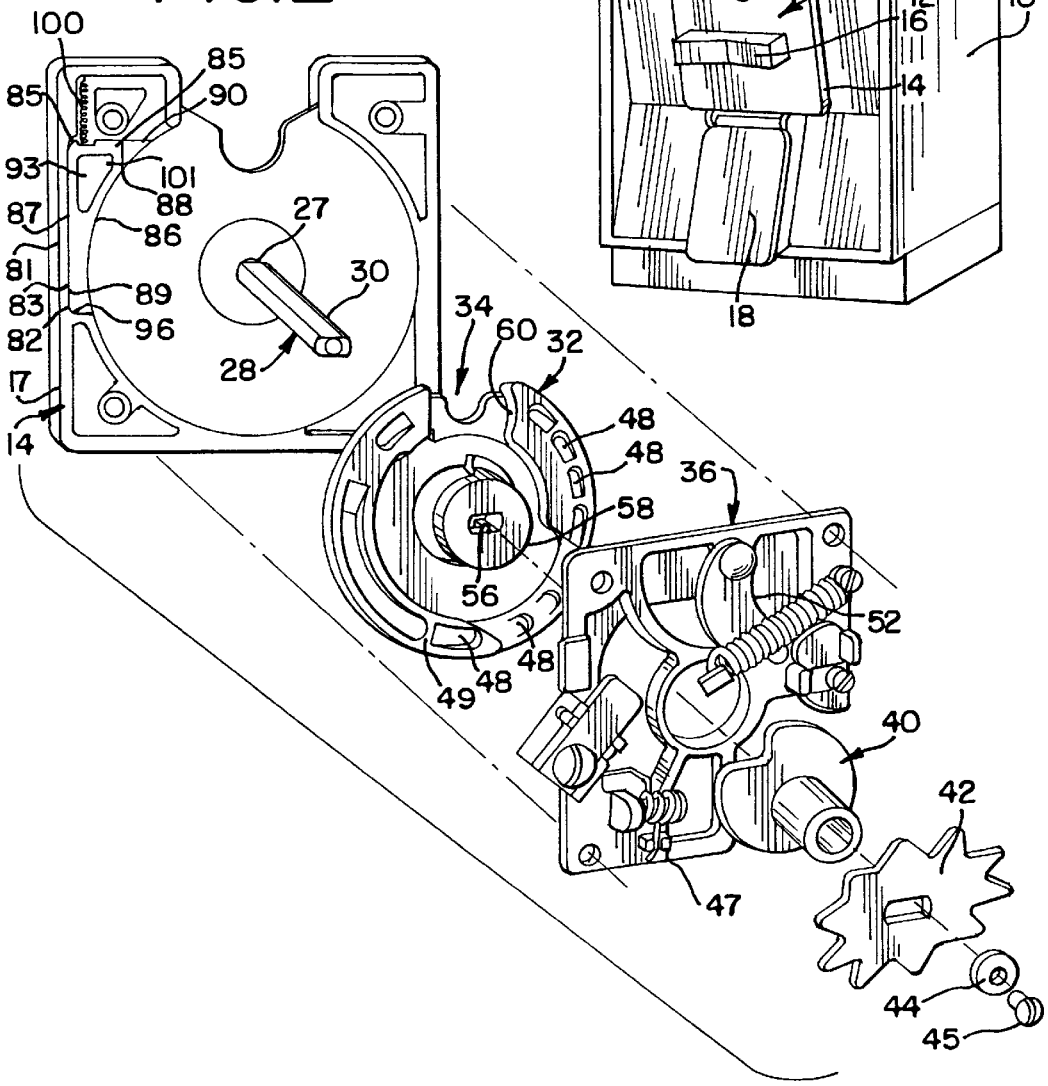
FIG. 2 is a perspective exploded view of an embodiment of the coin receiving mechanism, which is shown installed in the bulk vending machine of FIG. 1.
Figure 15:
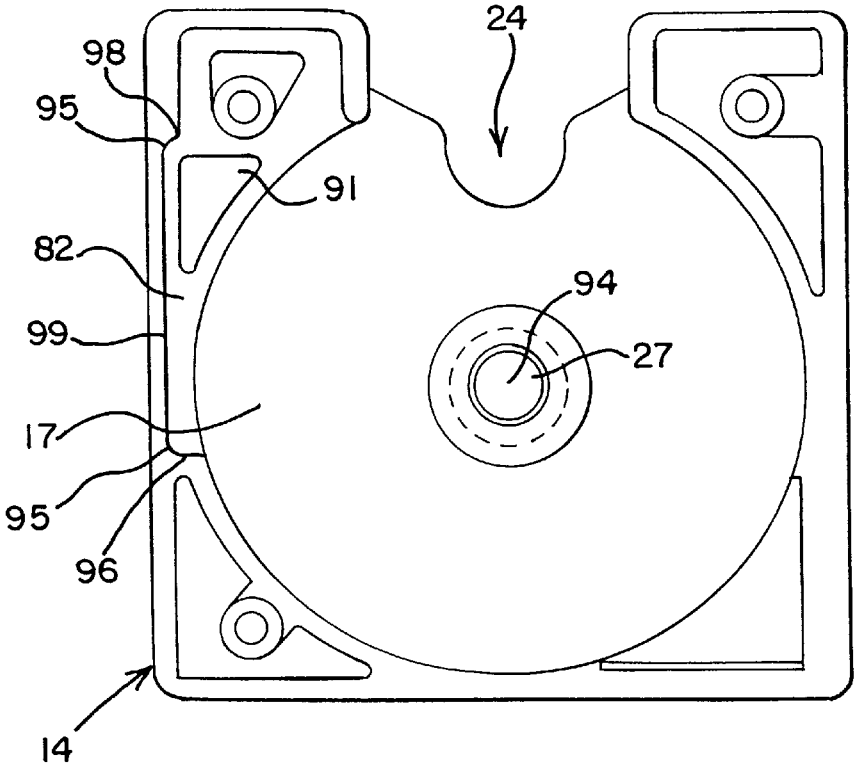
FIG. 15 is a plan view of the backside of an embodiment of the face plate of the improved coin mechanism for use in a bulk vending machine.

Referring to FIG. 2, the coin receiving portion 12 includes the face plate 14. The face plate 14 has a rear side 17. The face plate 14 mounts into an opening in the base unit 10, thereby mounting the coin receiving portion 12 into the base unit 10. The face plate 14 may be generally rectangular in shape and, as shown in FIG. 15 includes a slot 24, located on an upper side for receiving a coin. In the M60 and the Triple Play bulk vending machines, the face plate 14 is approximately 3⅜ inches wide and 3½ inches high.

Referring again to FIG. 2, extending through a centrally located opening 27 in the face plate 14 is a handle stem 28. The opening 27 in the face plate 14 for receiving the handle stem 28 is sized and adapted to allow the handle stem 28 to rotate with respect to the face plate 14. The handle stem 28 is connected to the handle 16 (shown in FIG. 1). The handle stem 28 preferably has a keyed shape, e.g., flattened sides 30.

Mounted on the handle stem 28 and engaging the keyed sides 30 thereof is a coin wheel 32. The coin wheel 32 is a planar disk shaped member having face and rear sides. The coin wheel 32 has located therein a first coin slot 34 located along the perimeter for receiving a coin of a proper denomination. The coin wheel 32 is mounted between the face plate 14 and a rear frame 36. Also mounted on the handle stem 28 are a cam 40 and a gear 42. A washer 44 and a mounting screw 45 connect to the stem 28 to maintain the coin wheel 32, cam 40, and gear 42 mounted thereon. The gear 42 engages the product dispensing portion (not shown) as mentioned above.

The rear frame 36 has mounted thereon a spring loaded secondary pawl 47 which abuts up against and engages a wall formed in notches 48 located in a perimeter area 49 of the coin wheel 32 to prevent rotation of the coin wheel 32 in other than its proper direction, e.g., counter-clockwise (when viewed from the face as in FIG. 1). Also attached to the back plate 36 is a return lever 52 which abuts against the cam 40 which is attached to the stem 28. Working together, the cam 40 and return lever 52 return the handle 16 to the starting position when it is turned.

The coin wheel 32 includes a keyed opening 56 formed in its center for receiving and engaging the handle stem 28. The coin wheel 32 also includes a raised cylindrical portion or hub 58 located around the opening 56. The raised cylindrical portion 58 provides for reinforcing the connection of the handle stem 28 to the coin wheel 32 and thereby to the coin receiving portion 12 and to the rest of the bulk vending machine 8 to make it more durable and resistant to vandalism or pilferage.

Figure 3:
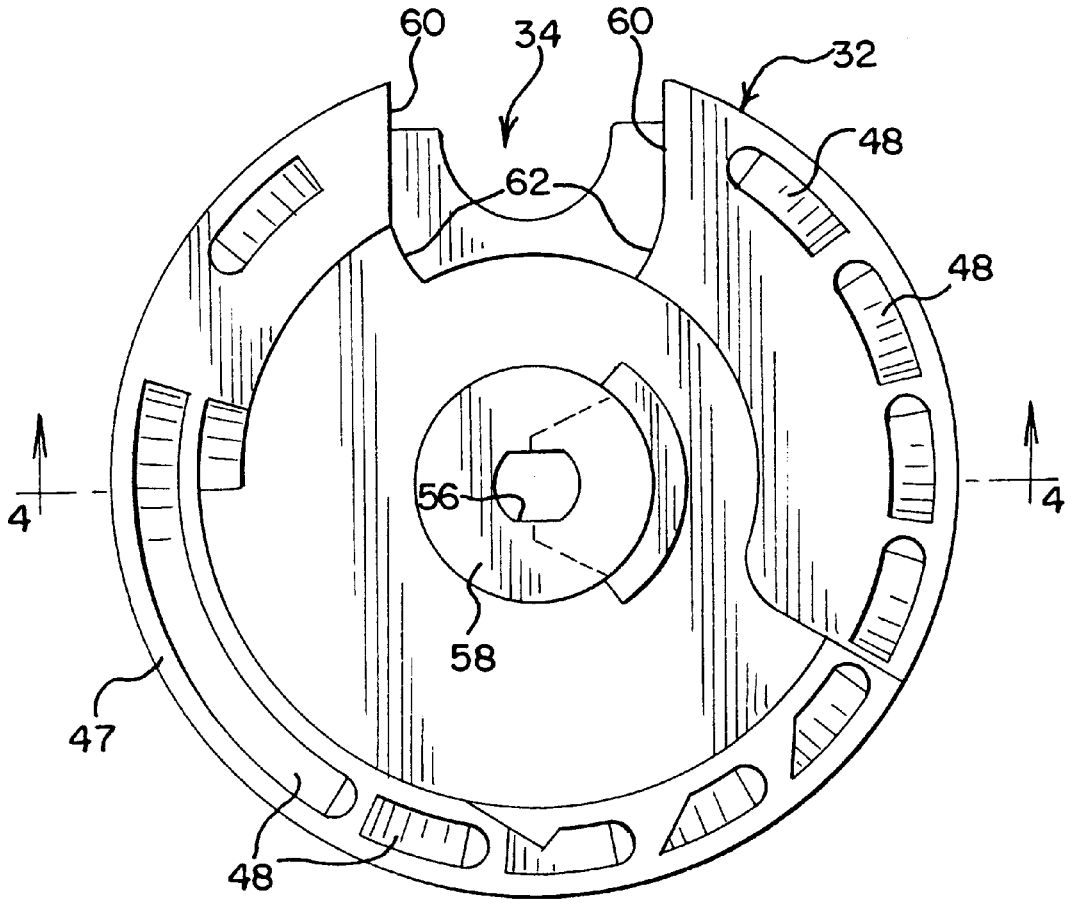
FIG. 3 is a face view of an embodiment of a coin wheel shown in FIG. 2.
Figure 4:
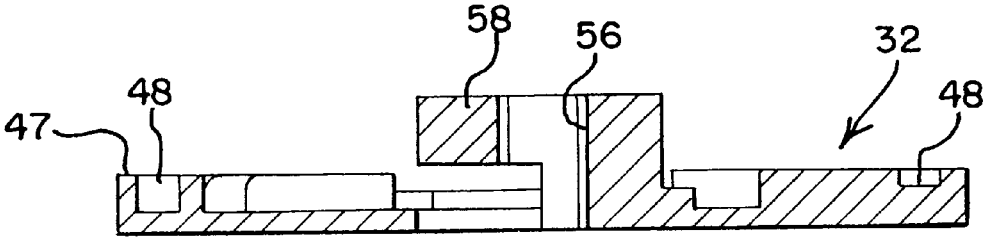
FIG. 4 is a cross sectional view taken along 4–4' of FIG. 3.

As shown in FIGS. 3 and 4, the coin wheel 32 has the first coin slot 34 located in a portion thereof to receive a coin of a proper denomination. The first coin slot 34 is located on the rear side of the coin wheel 32 and open to the perimeter to receive a coin therefrom. The first coin slot 34 includes side walls 60 sized and adapted to conform to the dimensions of a coin of a proper denomination. In the present embodiment, the coin of proper denomination is a U.S. quarter, so accordingly, the walls 60 are spaced approximately 15/16 inches apart. The walls 60 curve toward each other in lower portions 62 thereof to retain the coin of the proper denomination in position in the first slot of the coin wheel 32.

The coin wheel of the present embodiment may be similar or identical to the coin wheel disclosed in U.S. Pat. No. 5,339,937, the entire disclosure of which is hereby incorporated by reference.

Figure 5:
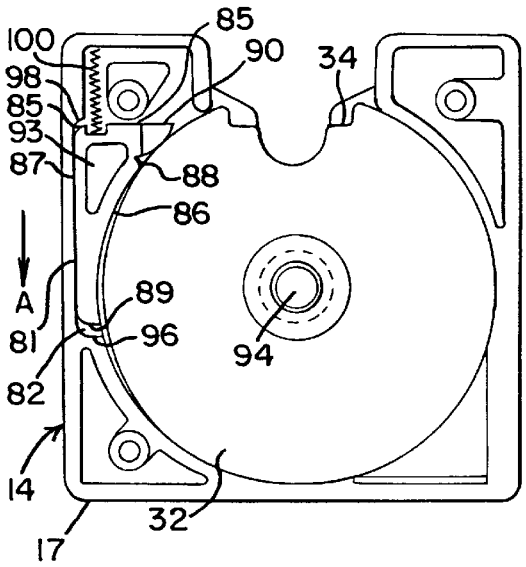
FIG. 5 is a plan view of an embodiment of the improved coin mechanism for use in a bulk vending machine wherein the coin wheel is in an initial position.
Figure 14:
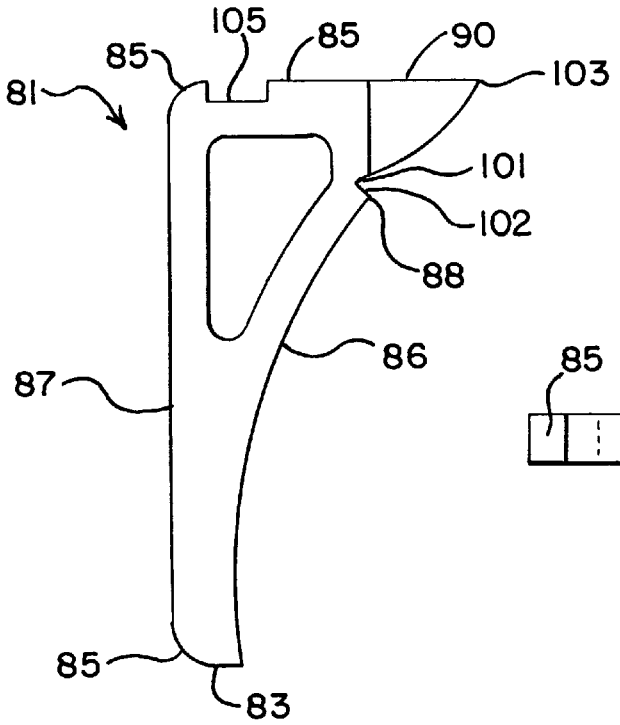
FIG. 14 is a plan view of an embodiment of the pawl of the improved coin mechanism for use in a bulk vending machine.

Referring to FIGS. 2, 5 and 14, on the back side 17 of the face plate 14, there is a movably attached spring loaded pawl 81. The pawl 81 prevents clockwise movement of the coin wheel 32 unless a genuine coin (e.g., a quarter) is located in the first coin slot 34. The pawl 81 is located in a recess 82 formed in the backside 17 of the face plate 14.

As shown in FIG. 15, the recess 82 is located in the upper left side of the backside 17 of the face plate 14, and is comprised of right, left, top and bottom edges. In a preferred embodiment the left edge 99 of the recess 82 is located approximately 1.615 in. from the center of the face plate 94, the bottom edge 96 of the recess 82 is located approximately 0.375 in. from the center of the face plate 94, and the top edge 98 of the recess 82 is located approximately 1.250 inches from the center of the face plate 94.

The shape of the recess 82 is generally adapted to receive the pawl 81. A depression 91 is formed within the recess. In a preferred embodiment, this depression 91 preferably has the same or a similar shape and size as the hole 93 that is in the pawl 81, described below. Alternatively, this depression 91 could be filled in to be at the same level of the rest of the recess 82.

The left edge 99 of the recess 82 is approximately 1.625 in. high. The left edge 99 of the recess 82 is connected to the top 98 and bottom 96 edges by arcs 95 of radius 0.093 in. As depicted in FIG. 15, the right hand side of the recess 82 is an arc of radius 2.96 in. The upper portion of the recess 82 is bounded by the walls of the back side 17 of the face plate 14.

The recess 82 is formed in the face plate 14 and thus is made of the same material as the face plate 14. The face plate 14 may be made of a metal such as zinc or an aluminum die casting. The recess 82 is adapted to accept and in part retain the pawl 81.

Referring to FIG. 5, the pawl includes a top surface 85, a right surface 86 and a left surface 87. For purposes of this disclosure, the right and left surfaces are defined when viewed from the back side 17 of the face plate 14. The top surface 85 contacts a spring 100 which biases the pawl 81 in a downward direction, as indicated by arrow A in FIG. 5. The right surface 86 of the pawl 81 is adjacent to the coin wheel 32. Formed in the right surface 86 of the pawl 81 is a secondary beak 88. Also, adjacent to the top surface 85 is a primary beak 90. The left surface 87 and the top surface 85 of the pawl 81 generally form an inverted "L" shape, with rounded edges 83. The right surface 86 generally forms an arc. The left surface 87 is approximately 1.50 in. in height, the top surface 85 is approximately 0.505 in. in width. The rounded edges have a radius of about 0.109 in. The right surface 86 has a radius of approximately 1.453 inches. Except for the primary beak 90, the pawl 81 has a thickness of about 0.125 inches.

The pawl 81 also includes a hole 93. The hole 93 is located just below the top surface 85, preferably about 0.144 in. below the top surface 85. The hole 93 reduces the weight of the pawl 81. The dimensions of the hole 93 are as follows: the left side is about 0.432 in. in height, the slanted portion of the right side is about 1.547 in. in length, the straight portion of the right side is about 0.65 in. in height, the width of the top portion is about 0.220 in. and the bottom edge has a radius of about 0.047 in.

Referring to FIG. 14, formed at the uppermost part of the right surface 86, just below the primary beak is the secondary beak 88. The secondary beak 88 is a sharp, triangular shaped point that is generally formed by the intersection of a notch 101 and the right surface 86. The bottom portion 102 of the notch 101 preferably forms approximately a 42 degree angle with the top surface 85. The notch has a radius of approximately 0.015 in.

Figure 13:
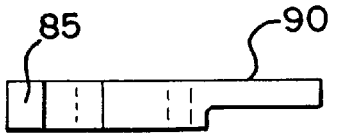
FIG. 13 is a top view of an embodiment of the pawl of the improved coin mechanism for use in a bulk vending machine.

Extending from the right side of the top surface 85 and located just above the notch 101, is the primary beak 90. The purpose of the primary beak 90 is to stop the clockwise motion of the coin wheel 32. The primary beak 90 is generally triangular shaped, however the hypotenuse of the primary beak 90 forms an arc. Further as shown in FIG. 14, the primary beak has a straight end 103. As shown in FIG. 13, the primary beak is thinner than the remainder of the pawl. Preferably, the primary beak 90 has an approximate thickness of 0.055 inches. In a preferred embodiment, the length of the primary beak 90 is approximately 0.291 in. and the height of the primary beak is about 0.250 in. The radius of the arc is 0.971 in. The straight end of the primary beak 90 has a height of about 0.020 in.

As shown in FIG. 14 a spring indentation 105 is formed in the top surface 85 of the pawl 81. The left edge of the spring indentation is preferably located 0.054 in. from the left surface 87. The bottom edge of the spring indentation is located 0.049 in. from the top surface. The spring indentation 105 has a height of 0.049 in. and a width of 0.312 in.

In a preferred embodiment, the pawl 81 is made of powdered metal such as steel. Alternatively, the pawl 81 may be milled from steel or another suitably hard material.

Referring again to FIGS. 2 and 5, disposed between the upper wall of the face plate 14 and the top surface 85 of the pawl 81 is the spring 100. The spring 100 has a length of approximately 47/64 in. and a diameter of 0.138 in. It preferably has 15 L.H. (left hand) coils and closed ends. Further, the spring 100 has a precoat finish and is preferably made of 0.022 music wire. In an alternative embodiment, the spring 100 may be a leaf spring. In another embodiment, instead of a spring 100 the pawl 81 may be biased downward by a magnet.

The spring 100 biases the pawl 81 in a downward direction. As shown in FIG. 5, when biased downward by the spring 100, the right surface 86 of the pawl 81 contacts the coin wheel 32, whereas the left surface 87 contacts the left edge 99 of the backside of the face plate 14. The pawl 81 functions to prevent the coin wheel 32 from turning in a clockwise direction unless a genuine quarter is inserted into the coin slot 34.

Figure 6:
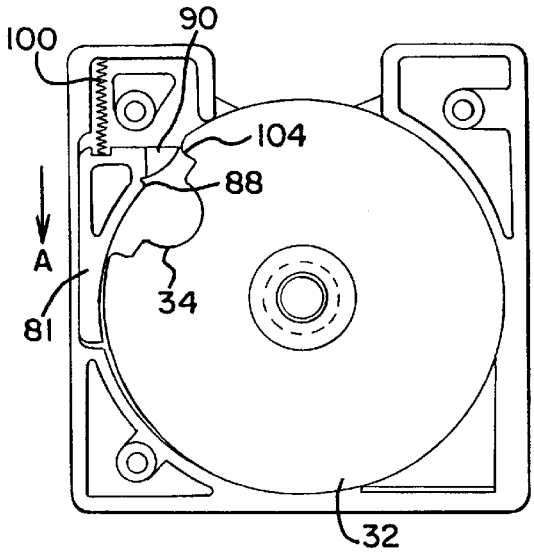
FIG. 6 is a plan view of an embodiment of the improved coin mechanism for use in a bulk vending machine wherein the coin wheel is in a second position.
Figure 7:
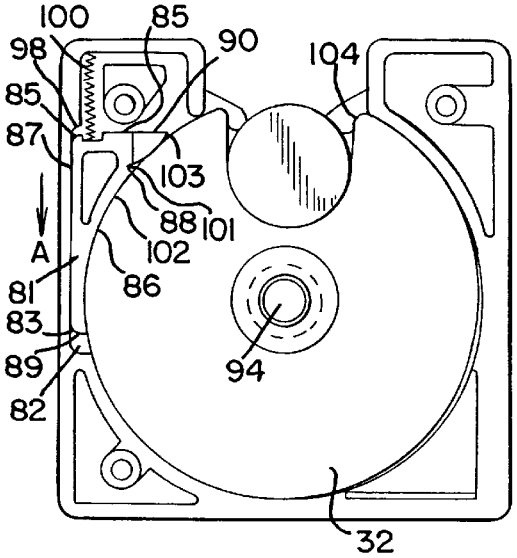
FIG. 7 is a plan view of an embodiment of the improved coin mechanism for use in a bulk vending machine wherein the coin wheel is in an initial position and a genuine quarter is in a first coin slot.
Figure 8:
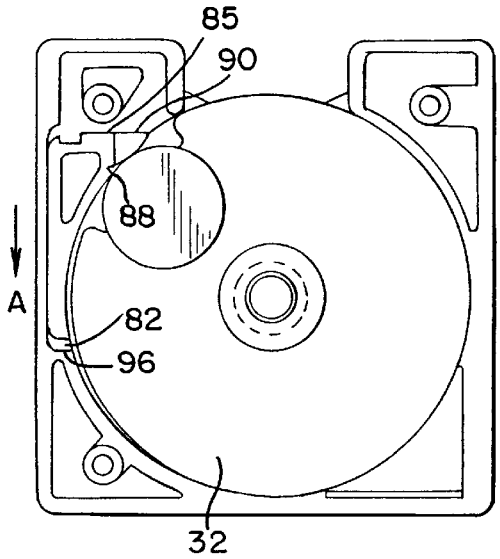
FIG. 8 is a plan view of an embodiment of the improved coin mechanism for use in a bulk vending machine wherein the coin wheel is in a second position and a genuine quarter is in a first coin slot.
Figure 9:
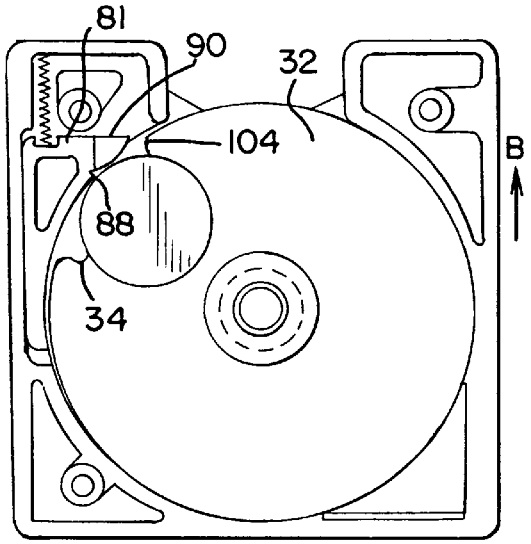
FIG. 9 is a plan view of an embodiment of the improved coin mechanism for use in a bulk vending machine wherein the coin wheel is in a third position and a genuine quarter is in a first coin slot.
Figure 10:
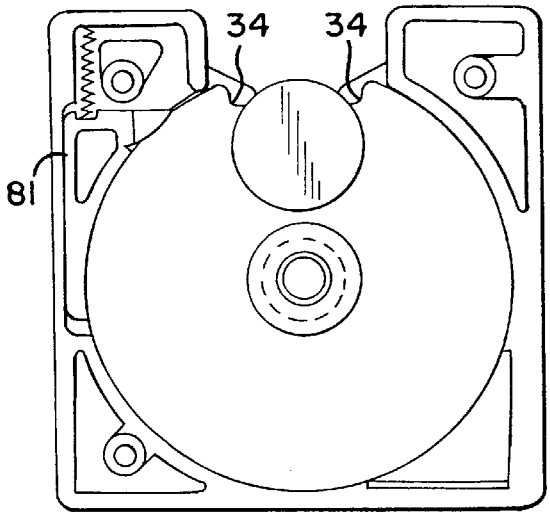
FIG. 10 is a plan view of an embodiment of the improved coin mechanism for use in a bulk vending machine wherein the coin wheel is in an initial position and a counterfeit coin is in a first coin slot.
Figure 11:
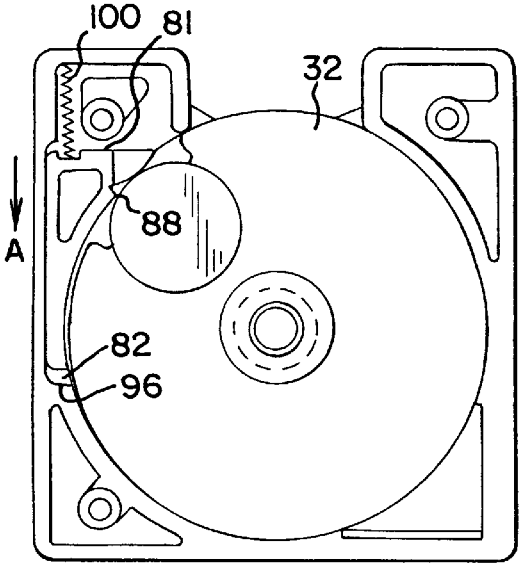
FIG. 11 is a plan view of an embodiment of the improved coin mechanism for use in a bulk vending machine wherein the coin wheel is in a second position and a counterfeit coin is in a first coin slot.
Figure 12:
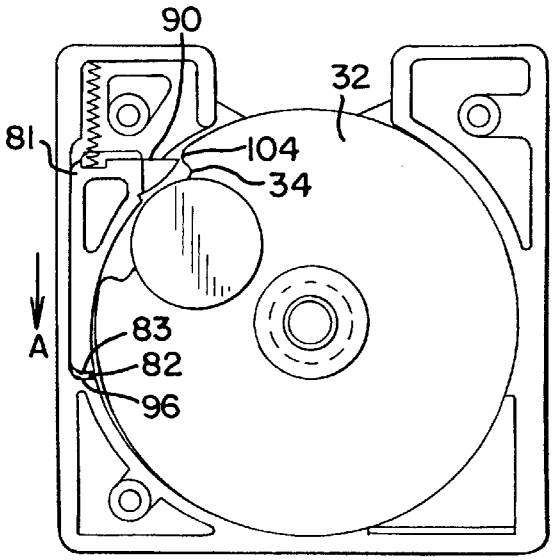
FIG. 12 is a plan view of an embodiment of the improved coin mechanism for use in a bulk vending machine wherein the coin wheel is in a third position and a counterfeit coin is in a first coin slot.

Operation of the improved coin receiving mechanism 12 will now be described with reference to FIGS. 5–13. FIGS. 5–6 show operation of the coin receiving mechanism 12 with no coin inserted in the first coin slot 34, FIGS. 7–9 show operation of the coin receiving mechanism 12 with a genuine coin and FIGS. 10–12 show operation of the coin receiving mechanism 12 with a counterfeit coin.

Referring to FIG. 5, in this case no coin is inserted into the first coin slot 34 of the coin wheel 32 and the coin wheel 32 is in an initial position. The pawl 81 is in a first position and is set into the recess 82 such that the pawl 81 is biased downward by the spring 100 so that it is slightly below the top edge 98 of the recess 82 and the right surface 86 of the pawl 81 as well as the primary beak 90 bear slidingly against the coin wheel 32. The left surface 87 contacts the left edge 99 of the recess and the bottom surface 89 of the pawl 81 is slightly above the bottom edge 96 of the recess 82. In a preferred embodiment, when the coin wheel 32 is in the starting position shown in FIG. 5, the top surface 85 of the pawl 81 is approximately 1.248 in. from the center of the face plate 94 and thus approximately 0.002 in. below the top edge 98 of the recess 82. The left surface 87 is approximately 1.606 in. from the center of the face plate 94. The bottom surface 89 is preferably approximately 1.500 in. from the top surface 85.

When the coin wheel 32 is in the initial position shown in FIG. 5, the secondary beak 88 contacts the coin wheel 32. Also, as shown in FIG. 5, the primary beak 90 contacts the coin wheel. Referring again to FIGS. 5–6, the user rotates the handle, which results in the coin wheel 32 rotating in a clockwise direction (as seen from the front as in FIG. 1). As the slot 34 of the coin wheel 32 passes the primary beak 90, the pawl 81 shifts downward in the direction of arrow A. After the coin wheel 32 has rotated approximately 45 degrees, it reaches the second position, depicted in FIG. 6. When the coin wheel 32 is in the second position, the pawl 81 is also in a second position. The pawl 81 has moved a distance downward towards the bottom edge 98 of the recess 82 from its first position when the coin wheel 32 was in its initial position shown in FIG. 5.

The pawl 81 has traversed the initial space that existed between the bottom surface 83 of the pawl 81 and the bottom edge 96 of the recess 82 when the coin wheel 32 was in the starting position shown in FIG. 5. Specifically, the pawl 81 has shifted downward an approximate distance of 0.25 in. As a result of the pawl 81 sliding down to the second position, the primary beak 90 contacts the wall of the first coin slot 34 at the contact point 104. This contact stops the clockwise motion of the coin wheel 32. However, the wheel 32 does not jam and may be returned to the starting position shown in FIG. 5.

Referring to FIG. 7, a genuine coin, in this case a quarter, is inserted into the first coin slot 34 of the coin wheel 32 and the coin wheel 32 is in an initial position. After insertion of the quarter, the user rotates the handle 16, which results in the coin wheel 32 rotating in a clockwise direction.

As the coin wheel 32 rotates, the pawl 81 shifts downward in the direction of arrow A. After the coin wheel 32 has rotated approximately 45 degrees, it reaches the second position, depicted in FIG. 8. In the second position, the pawl 81 is in an intermediate position. The pawl 81 has moved a slight distance downward towards the bottom edge 96 of the recess 82 from its first position when the coin wheel 32 was in its initial position. In the second position, the pawl 81 has engaged the quarter. Specifically, the primary beak 90 and the secondary beak 88 are contacting the quarter. At this position, a significant amount of pressure is being applied to an edge of the quarter at the location of the secondary beak 88. The geometry of the secondary beak 88 assists in enhancing and focusing this pressure.

Referring to FIG. 9, the coin wheel 32 rotates approximately 5 degrees to the third position. In this third position, the genuine quarter imparts a force to the secondary beak 88, which causes the pawl 81 to move upward in the direction of arrow B. As a result, the pawl 81 is near its first position, thus allowing the top of the coin slot 34 including the contact point 104 to pass underneath the primary beak 90. Once the coin wheel 32 is fully inverted, the quarter falls into a tray located internally to the housing for secure storage until it is emptied.

Referring to FIG. 10, once again the coin wheel 32 is in an initial position. Also, the pawl 81 is in a first position as above-described. In this case, a counterfeit coin that is the same size as the quarter but made from a softer yet stiff material is inserted into the slot 34. For example, the counterfeit coin may be made of cardboard, tile, iron, or aluminum.

At the second position, shown in FIG. 11, the coin wheel 32 has rotated approximately 45 degrees. As the coin wheel 32 rotates the pawl 81 shifts downward in the direction of arrow A. In the second position, the pawl 81 has moved from its first position towards the bottom edge 96 of the recess 82 to an intermediate position. In this position, the pawl 81 has engaged the counterfeit coin. Specifically, the primary beak 90 as well as the secondary beak 88 are contacting the counterfeit coin. As with the quarter, a significant amount of pressure is being applied to an edge of the counterfeit coin at the location of the secondary beak 88. Unlike the quarter, however, the counterfeit coin is not able to move the pawl 81 upward, because the counterfeit coin is made of a softer material which, as shown in FIG. 12, results in the secondary beak 88 digging into and deforming an edge of the counterfeit coin.

As the coin wheel 32 rotates to a third position, the secondary beak 88 continues to dig into an edge of the counterfeit coin resulting in the pawl 81 being pushed by the spring 100 further in a downward direction, illustrated by arrow A. The pawl 81 moves from the intermediate position shown in FIG. 11 to the second position shown in FIG. 12. This second position shown in FIG. 12 is close to the second position depicted in FIG. 6 and discussed above. This second position is slightly below the intermediate position and thus closer to the bottom edge 96 of the recess 82.

Thus, the pawl 81 has traversed the initial space that existed between the bottom surface 83 of the pawl 81 and the bottom edge 96 of the recess 82 when the coin wheel 32 was in the starting position shown in FIG. 10. Specifically, the pawl 81 has shifted downward an approximate distance of 0.25 in. As a result of the pawl 81 sliding down to the second position, the primary beak 90 contacts the wall of the slot at the contact point 104. This contact stops the clockwise motion of the coin wheel 32. However, the wheel 32 does not jam and may be returned to the starting position of shown in FIG. 10, at which point the counterfeit coin can be removed.

One of the advantages of the movement of the pawl 81 is that when it shifts downward it moves translationally relative to the face plate 14 and in a preferred embodiment does not pivot. In a preferred embodiment the top, bottom, right and left surfaces of the pawl 81 are translationally movable relative to the top and left edges of the recess 82. One reason that this translational movement functions better than a pivoting movement is that it provides a better angle for the pawl 81 to engage a coin and the coin wheel 32.

In an alternative embodiment, the pawl 81 may be formed such that the secondary beak 88 has a different shape. For example, instead of being triangular shaped the secondary beak 88 may be truncated at its end or the secondary beak 88 may be squared off on its end. In addition, the spring constant of the spring 100 may be varied to adjust the pressure that is focused on the edge of the disk or coin at the secondary beak 88. The amount of pressure that is applied at the secondary beak 88 is also related to the dimensions of the secondary beak 88. Accordingly, the spring constant and the dimensions of the secondary beak 88 may be varied in an alternative embodiment to find an appropriate balance to prevent a counterfeit coin of particular stiffness from passing through.

Thus for coin mechanisms that are placed in units which are in unattended areas, high volume areas, or areas in which a large number of counterfeit coins have been inserted in the past, the existing spring 100 can be easily replaced in the pawl 81, thus resulting in a greater amount of force on the edge of the coin.

It is a further advantage of the present embodiment, that the improved pawl can not only be used in new models of the M60 and Triple Play, but can also be retrofitted in older models by replacing the face plate of these models with a face plate such as shown in FIG. 15.

It is intended that the foregoing detailed description be regarded as illustrative rather than limiting and that it is understood that the following claims including all equivalents are intended to define the scope of the invention.

What is claimed is:

1. A coin receiving mechanism for a vending machine comprising:

(a) a face plate;

(b) a coin wheel received in an indention formed in a backside of said face plate, said coin wheel having formed therein a first coin slot for receiving coins; and (c) a biased pawl movable between a first position and a second position and located in a recess formed in a of said face plate, said pawl having a primary beak and a secondary beak formed therein, and wherein said secondary beak bears against an edge of a coin in said first coin slot as said coin passes.

2. The coin receiving mechanism of claim 1, wherein said secondary beak extends outward from said pawl.

3. The coin receiving mechanism of claim 1, wherein said secondary beak is triangular shaped.

4. The coin receiving mechanism of claim 1, wherein said pawl is formed from a powdered metal.

5. The coin receiving mechanism of claim 1, wherein said pawl is formed from steel.

6. The coin receiving mechanism of claim 1, wherein said pawl has a top surface and a right surface.

7. The coin receiving mechanism of claim 6, wherein said pawl has a notch formed therein.

8. The coin receiving mechanism of claim 7, wherein said secondary beak is formed at the intersection of said notch and said right surface.

9. The coin receiving mechanism of claim 1, wherein said pawl has a top surface and said primary beak is adjacent to said top surface.

10. The coin receiving mechanism of claim 1, wherein said pawl is biased using a spring.

11. The coin receiving mechanism of claim 1, wherein said coin is a genuine coin.

12. The coin receiving mechanism of claim 1, wherein said coin is a counterfeit coin.

13. The coin receiving mechanism of claim 1, wherein said coin is a U.S. quarter dollar.

14. The coin receiving mechanism of claim 1, wherein said pawl is movable to an intermediate position.

15. A method for operating a vending machine comprising:

(a) accepting a coin of required size and stiffness; and (b) rejecting a counterfeit coin of less stiffness than a required coin by contacting said counterfeit coin with a biased pawl movable between a first position and a second position, said pawl having a primary and a secondary beak formed therein, and wherein said secondary beak bears against an edge of said counterfeit coin as said counterfeit coin passes resulting in said pawl moving from a first position to a second position.

16. The method for operating a vending machine of claim 15, wherein a genuine coin is inserted.

17. The method for operating a vending machine of claim 16, wherein said genuine coin is in an initial position.

18. The method for operating a vending machine of claim 17, wherein said genuine coin is moved from an initial position to a second position.

19. The method for operating a vending machine of claim 18, wherein said pawl is moved from a first position to an intermediate position.

20. The method for operating a vending machine of claim 19, wherein said secondary beak contacts said genuine coin.

21. The method for operating a vending machine of claim 20, wherein said genuine coin is moved from said second position to a third position and pushes said pawl upward.

22. The method for operating a vending machine of claim 15, wherein a counterfeit coin is inserted.

23. The method for operating a vending machine of claim 22, wherein said counterfeit coin is in an initial position.

24. The method for operating a vending machine of claim 23, wherein said counterfeit coin is moved from said initial position to a second position.

25. The method for operating a vending machine of claim 24, wherein said pawl moves from said first position to an intermediate position.

26. The method for operating a vending machine of claim 25, wherein said secondary beak contacts said counterfeit coin in said second position.

27. The method for operating a vending machine of claim 26, wherein said counterfeit coin is moved from said second position to a third position, resulting in said pawl moving from said intermediate position to a second position and a primary beak engaging a coin wheel thereby preventing further movement of said counterfeit coin.

28. A coin receiving mechanism for a vending machine comprising:

(a) a face plate, said face plate formed therein a slot for receiving coins;

(b) a rotatable coin wheel received in an indention formed in a backside of said face plate having a first coin slot for receiving coins; and (c) a biased pawl movable between a first position and a second position and located in a recess formed in a backside of said faceplate, said pawl having a top surface, a right surface and a primary beak, said top surface contacting a spring to downwardly bias the pawl, and said right surface adjacent to said coin wheel and having a secondary beak formed therein, said secondary beak bears against an edge of a coin in said slot as said coin passes and said primary beak adjacent to said top surface and engageable with said coinwheel to prevent movement thereof upon insertion of a counterfeit coin with less stiffness than a required coin.

29. A method for operating a vending machine comprising:

(a) accepting a coin of required size and stiffness;

(b) rejecting a disk of less stiffness than a required coin by contacting said disk with a biased pawl movable between a first position and a second position, said pawl having a top surface, a right surface and a primary beak, said top surface contacting a spring to downwardly bias the pawl, and said right surface adjacent to a coin wheel bears against an edge of said disk as said disk passes resulting in said pawl moving from a first position to a second position, and a primary beak engaging said coin wheel to prevent movement thereof.

30. A coin receiving mechanism for a vending machine comprising:

(a) a face plate;

(b) a coin wheel received in an indention formed in a backside of said face plate, said coin wheel formed therein a first coin slot for receiving coins; and (c) a biased pawl located in a recess formed in a backside of said face plate, said pawl translationally movable, relative to a left edge and a top edge of said recess, between a first position and a second position, said pawl having a primary and a secondary beak formed therein, and said secondary beak bears against an edge of a coin in said first coin slot as said coin passes.

31. The coin receiving mechanism of claim 30 wherein said top surface of said pawl is translationally movable relative to said left edge and said top edge of said recess, in a downward direction.

32. The coin receiving mechanism of claim 30 wherein said bottom surface of said pawl is translationally movable, relative to said left edge and said top edge of said recess, in a downward direction.

33. The coin receiving mechanism of claim 30 wherein said left surface of said pawl is translationally movable relative to said left edge and said top edge of said recess, in a downward direction.

34. The coin receiving mechanism of claim 30 wherein said right surface of said pawl is translationally movable, relative to said left edge and said top edge of said recess, in a downward direction.

35. A method for operating a vending machine comprising:

(a) accepting a coin of required size and stiffness; and (b) rejecting a counterfeit coin of less stiffness than a required coin by contacting said counterfeit coin with a biased pawl located in a recess formed in a backside of said face plate, said pawl translationally movable, relative to a left edge and a top edge of said recess, between a first position and a second position, said pawl having a primary and a secondary beak formed therein, and said secondary beak bears against an edge of said counterfeit coin as said counterfeit coin passes resulting in said pawl moving from a first position to a second position.

36. The method for operating a vending machine of claim 35, wherein said top surface of said pawl is translationally movable, relative to said left edge and said top edge of said recess, in a downward direction.

37. The method for operating a vending machine of claim 35, wherein said left surface of said pawl is translationally movable, relative to said left edge and said top edge of said recess, in a downward direction.

38. The method for operating a vending machine of claim 35, wherein said right surface of said pawl is translationally movable, relative to said left edge and said top edge of said recess, in a downward direction.

39. The method for operating a vending machine of claim 35, wherein said bottom surface of said pawl is translationally movable, relative to said left edge and said top edge of said recess, in a downward direction.

* * * * *

UNITED STATES PATENT AND TRADEMARK OFFICE

CERTIFICATE OF CORRECTION

PATENT NO. : 6,079,540
DATED : June 27, 2000
INVENTOR(S) : Richard K. Bolen

It is certified that error appears in the above-identified patent and that said Letters Patent is hereby corrected as shown below:

Claim 1,
Line 8, delete "in a of" and substitute -- in a backside of -- in its place.

Signed and Sealed this

Twenty-third Day of October, 2001

*Attest:*

Nicholas P. Godici

*Attesting Officer*

NICHOLAS P. GODICI
*Acting Director of the United States Patent and Trademark Office*